US006865979B1

(12) United States Patent
Vaid

(10) Patent No.: US 6,865,979 B1
(45) Date of Patent: Mar. 15, 2005

(54) APPARATUS AND METHOD FOR REMOVING THE SLIDE OF A SEMI-AUTOMATIC PISTOL

(75) Inventor: Pardip K. Vaid, Northampton, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/778,490

(22) Filed: Feb. 7, 2001

(51) Int. Cl.[7] ..... F41A 19/44
(52) U.S. Cl. ..... 89/144; 42/90
(58) Field of Search ..... 89/144, 145, 146, 89/147, 163; 42/69.01, 69.02, 69.03, 70.02, 90

(56) References Cited

U.S. PATENT DOCUMENTS

| | | | | | |
|---|---|---|---|---|---|
| 1,896,820 | A | * | 2/1933 | Jolidon | 89/163 |
| 3,857,325 | A | * | 12/1974 | Thomas | 89/138 |
| 4,291,481 | A | * | 9/1981 | Hillberg | 89/196 |
| 4,627,184 | A | * | 12/1986 | Ruger et al. | 42/75.03 |
| 4,893,546 | A | | 1/1990 | Glock | |
| 5,160,796 | A | * | 11/1992 | Tuma et al. | 42/69.03 |
| 5,386,659 | A | | 2/1995 | Vaid et al. | |
| 5,438,784 | A | | 8/1995 | Lenkarski et al. | |
| 5,717,156 | A | * | 2/1998 | Lenkarski | 42/17 |
| 5,797,206 | A | * | 8/1998 | Vitorino | 89/69.03 |
| 5,815,973 | A | * | 10/1998 | Hochstrate | 42/69.03 |

FOREIGN PATENT DOCUMENTS

| | | | | |
|---|---|---|---|---|
| DE | 299719 | * | 9/1921 | 89/145 |
| FR | 901082 | * | 7/1945 | 89/145 |

* cited by examiner

*Primary Examiner*—Stephen M. Johnson
(74) *Attorney, Agent, or Firm*—McCormick Paulding & Huber LLP

(57) ABSTRACT

A method for removing the slide from a semi-automatic firearm is provided that includes the steps of: (1) providing an access port within the slide of the firearm that is positioned to align with the firing mechanism of the firearm; (2) inserting a probe into the access port; and (3) manipulating the firing mechanism with the probe, and thereby enabling the slide to be removed from the frame. A semi-automatic firearm is also provided that includes a frame, a slide removably mounted on the frame, a striker firing-pin mounted within the slide, a firing mechanism, and an access port disposed in the slide. When the slide is in a predetermined position, the firing mechanism can be accessed through the access port with a probe and manipulated to allow removal of the slide from the frame.

10 Claims, 3 Drawing Sheets

APPARATUS AND METHOD FOR REMOVING THE SLIDE OF A SEMI-AUTOMATIC PISTOL

BACKGROUND OF THE INVENTION

1. Technical Field

This invention applies to semi-automatic firearms in general, and to apparatus and methods for removing the slide of a semi-automatic firearm in particular.

2. Background Information

A semi-automatic pistol includes a slide assembly slidably mounted on a frame, a firing mechanism, and a magazine. The magazine is received within the handle portion of frame. The firing mechanism is mounted in the frame and includes a trigger, a trigger bar, and a spring activated striker-firing pin. The trigger bar is pivotally mounted on one end to the trigger and on the other end to a mechanism that actuates the striker firing-pin. In some pistols, a sear assembly is the mechanism that actuates the striker firing-pin. Movement of the trigger causes the pivotally connected trigger bar to move laterally within the frame and actuate the sear assembly out of engagement with the striker firing-pin, thereby allowing the striker firing-pin to engage an ammunition round loaded in the firing chamber unless otherwise prevented by another safety.

Most pistols today include a magazine safety to ensure the firearm cannot be fired when the magazine is removed. Many of those magazine safeties operate by impairing the ability of the firing mechanism to move an amount sufficient to fire the firearm. In those instances, it may not be possible to remove the glide from the frame of the firearm while the magazine is removed. It would be advantageous to be able to remove the slide from the frame while the magazine is removed from the firearm.

What is needed, therefore, is an apparatus and a method for removing the slide from a firearm that can be done while the magazine is removed from the firearm.

DISCLOSURE OF THE INVENTION

It is, therefore, an object of the present invention to provide an apparatus and a method for removing the side from a firearm that can be done while the magazine is removed from the firearm.

According to one aspect of the present invention, a method for removing the slide from a semi-automatic firearm is provided that includes the steps of: (1) providing an access port within the slide of the firearm that is positioned to align with the firing mechanism of the firearm; (2) inserting a probe into the access port; and (3) manipulating the firing mechanism with the probe, and thereby enabling the slide to be removed from the frame.

According to another aspect of the present invention, a semi-automatic firearm is provided that includes a frame, a slide removably mounted on the frame, a striker firing-pin mounted within the slide, a firing mechanism, and an access port disposed in the slide. When the slide is in a predetermined position, the firing mechanism can be accessed through the access port with a probe and manipulated to allow removal of the slide from the frame.

An advantage of the present invention is that the slide can be removed when the magazine is removed from the firearm. The procedure for removing the slide of a pistol typically involves some movement of the firing mechanism. Most magazine safeties impair movement of the firing mechanism when the magazine is removed from the magazine well. As a result, the slide cannot be removed unless the magazine is received within the magazine well of the firearm. The present invention permits the slide to be removed with the magazine removed from the firearm.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
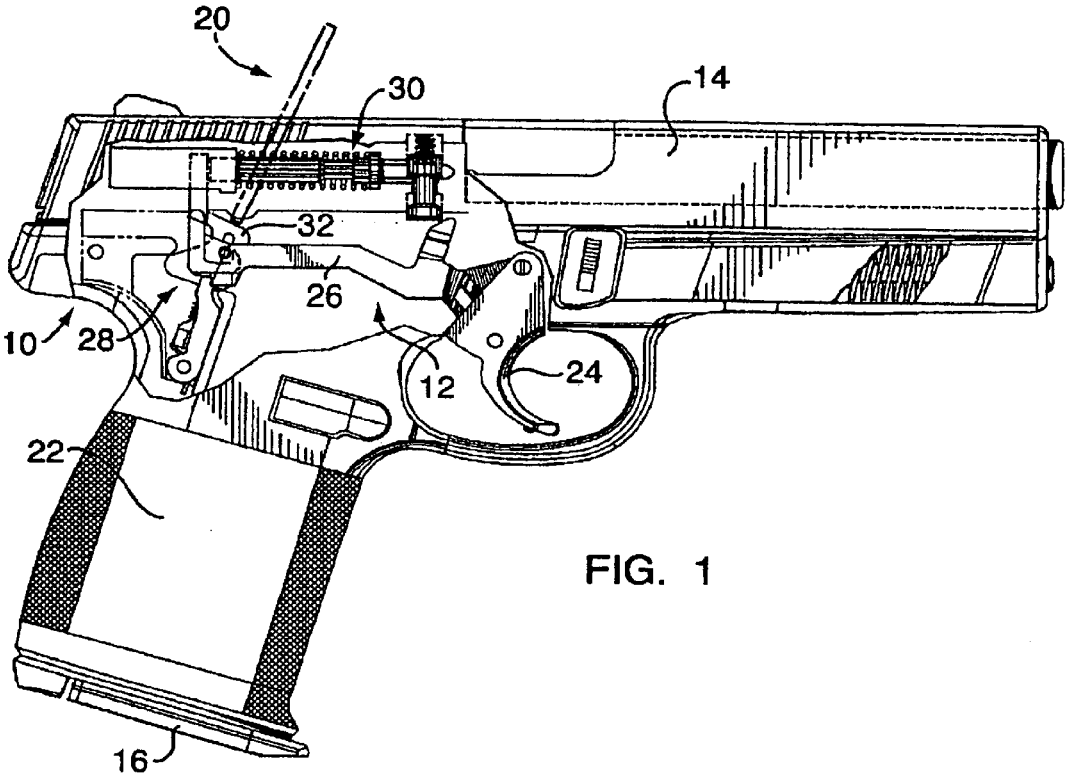
FIG. 1 is a diagrammatic partially section view of a semi-automatic pistol type firearm.

Referring to FIG. 1, a semi-automatic pistol includes a frame 10, a firing mechanism 12, a slide 14, a magazine 16, a magazine safety 18 (see FIG. 6), and apparatus 20 for removing the slide. The magazine 16 is received within the handle portion 22 of frame 10. The firing mechanism 12 is mounted in the frame 10, and includes a trigger 24, a trigger bar 26, a sear assembly 28, and a spring activated striker-firing pin mechanism 30. The trigger bar 26 is pivotally mounted on one end to the trigger 24 and on the other end to the sear assembly 28. Movement of the trigger 24 causes the pivotally connected trigger bar 26 to move laterally within the frame 10 and actuate the sear assembly 28 as will be described in more detail below. Actuation of the sear assembly 28 causes the sear 32 to disengage with the striker-firing pin mechanism 30 and thereby allow the mechanism 30 to engage an ammunition round loaded in the firing chamber unless otherwise prevented.

Figure 2:
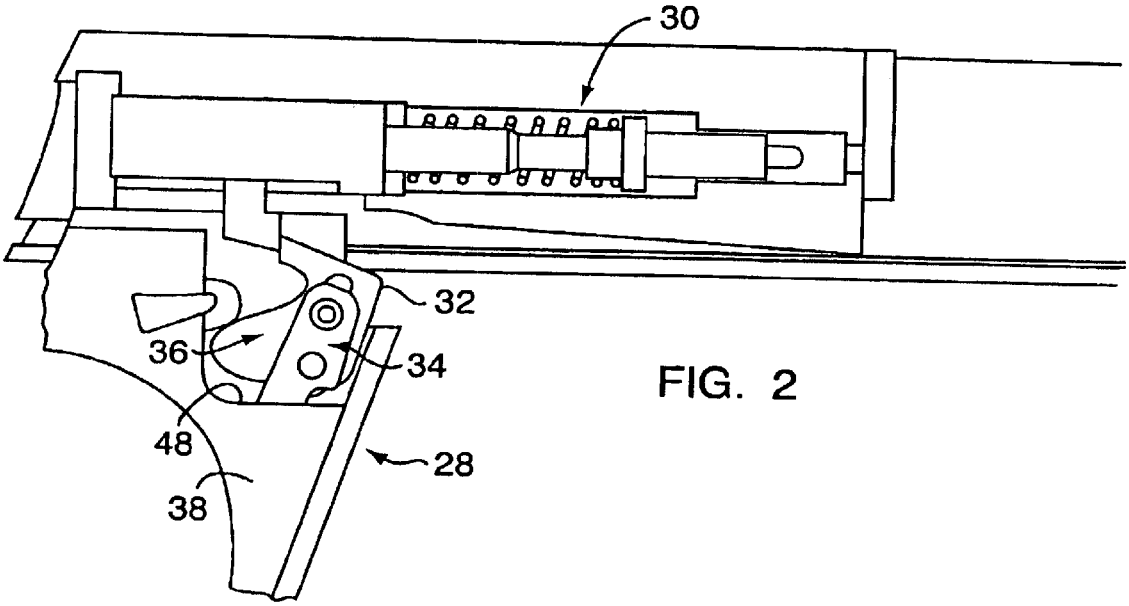
FIG. 2 is a diagrammatic partial view of a first type of pistol firing mechanism.

The rear assembly 28 shown in FIGS. 2 and 46, includes a sear 32, a sear guide 34, a swing arm 36, a housing 38, a sear spring 40, and a swing arm spring 42. The swing arm 36 includes a pair of panels 44,46 within a cavity 48 located in the sear housing 38. The swing arm panels 44,46 are pivotally mounted on one end by a pivot pin 50 that extends through the housing cavity 48. The sear 32 is slidably disposed between the swing arm panels 44,46 at the other end of the swing arm 36. The sear guide 34 includes a pair of pins 52,54 that extend between the swing arm panels 44,46 and through a slot 56 in the sear 32. A portion 58 of one of the sear pins 52,54 also extends a distance outside of one of the swing arm panels 44,46. The sear pins 52,54 limit the travel motion of the sear 32 along a line extending between the two pins 52,54. The pivot mounting arrangement of the swing arm 36 within the housing cavity 48 enables the sear 32 and the swing arm 36 to rotate within the housing cavity 48. The sear spring 40 biases the sear 32 toward the end of the swing arm 36 opposite the pivot pin 50. The swing arm spring 42, which is mounted on the swing arm pivot pin 50, biases the swing arm 36 toward a "forward" position, located at one end of the swing arm's arcuate path. Both the sear spring 40 and the swing arm spring 42 resist the actuation of the trigger 24. When the pistol is in a fireable condition, actuation of the trigger 24 and pivotally mounted trigger bar 26 causes the sear 32 and attached swing arm 36 to rotate about the pivot pin 50. After a certain amount of travel, the sear 32 disengages the striker firing-pin mechanism 30 (see FIGS. 1 and 2) and thereby permits the striker firing-pin to spring forward and strike the primer on the round of ammunition, if any, loaded in the firing chamber.

Figure 6:
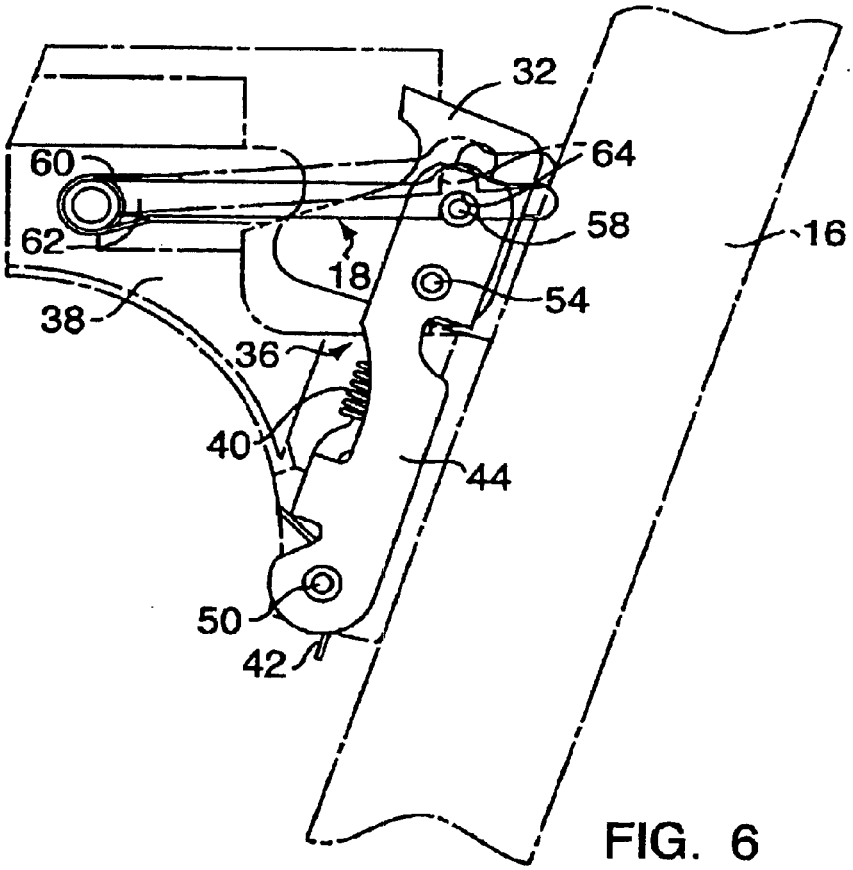
FIG. 6 is a diagrammatic view of a sear assembly that includes a magazine safety.

Referring to FIG. 6, the magazine safety 18 is included to prevent the firearm from being fired when the magazine 16 is removed. The magazine safety 18 includes a lever spring 60 and a lever 62 that is pivotally mounted to the sear housing 38. The lever 62 includes a notch 64 for receiving the sear pin portion 58 that extends outside a swing arm panel 44,46. The lever spring 60 acts on the lever 62 to bias it into engagement with the sear pin 52,54. When the sear pin 52,54 is received within the lever notch 64, the sear 32 and swing arm 36 are held in position and cannot be rotated about the swing arm pivot pin 50. The trigger bar 26 that mechanically connects between the sear 32 and the trigger 24 consequently does not permit the trigger 24 to be actuated an amount that would cause the pistol to be fired. Thus, when the magazine 16 is removed from the magazine well movement of the firing mechanism 12 is impaired to an extent that the firing mechanism cannot be actuated unless the magazine safety is disengaged. When the magazine 16 is fully inserted into the pistol's magazine well, the magazine 16 contacts the lever 62 causing it to rotate out of engagement with the sear pin portion 58. As a result, the sear 32 and the swing arm 36 are no longer held in position and the pistol may be fired unless otherwise prevented. The phantom line view of the lever 62 shows the lever 62 displaced by the magazine 16. An example of the above described magazine safety 18 is disclosed in U.S. Pat. No. 5,438,784 issued to Lenkarski and commonly assigned to the assignee of the present application. U.S. Pat. No. 5,438,784 is hereby incorporated by reference.

Referring to FIG. 1, in a pistol that utilizes a striker firing-pin type mechanism 30 the slide 14 can be removed by first depressing the slide catch (not shown) and subsequently sliding the slide backward along the frame 10. In the absence of a magazine safety 18 (e.g., like that described above), the movement of the slide 14 along the frame rails causes the sear 32 (or other type firing mechanism) to disengage from the striker firing-pin mechanism 30. Once the sear 32 is rotated out of engagement the slide 14 can be removed from the frame 10. If a magazine safety 18 is of the type that does not allow the striker firing-pin mechanism 30 to be actuated when engaged, then it will not be possible to remove the slide 14 from the frame 10 unless the magazine safety 18 is disengaged by reinserting the magazine 16 within the magazine well. In many instances, it would be preferable to be able to remove the slide 14 from the frame 10 without first having to reinsert the magazine 16.

Figure 7:
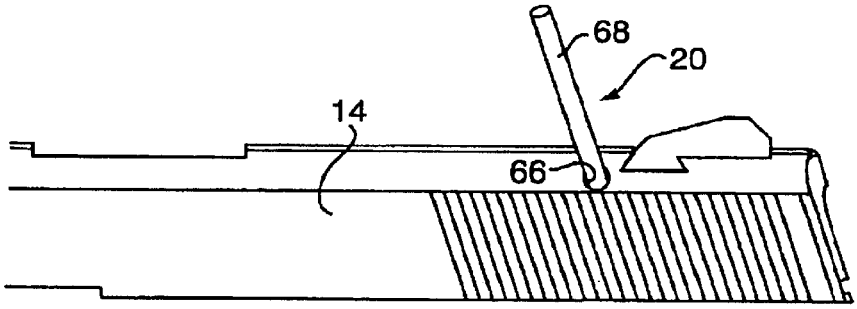
FIG. 7 is a partial side view of a slide showing a probe inserted into an access port.
Figure 8:
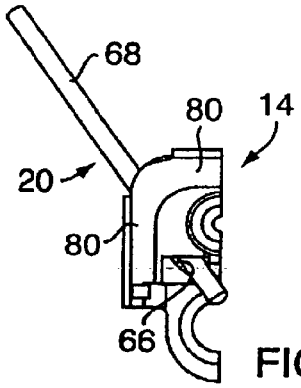
FIG. 8 is a partial end view of a slide showing a probe inserted into an access port.
Figure 3:
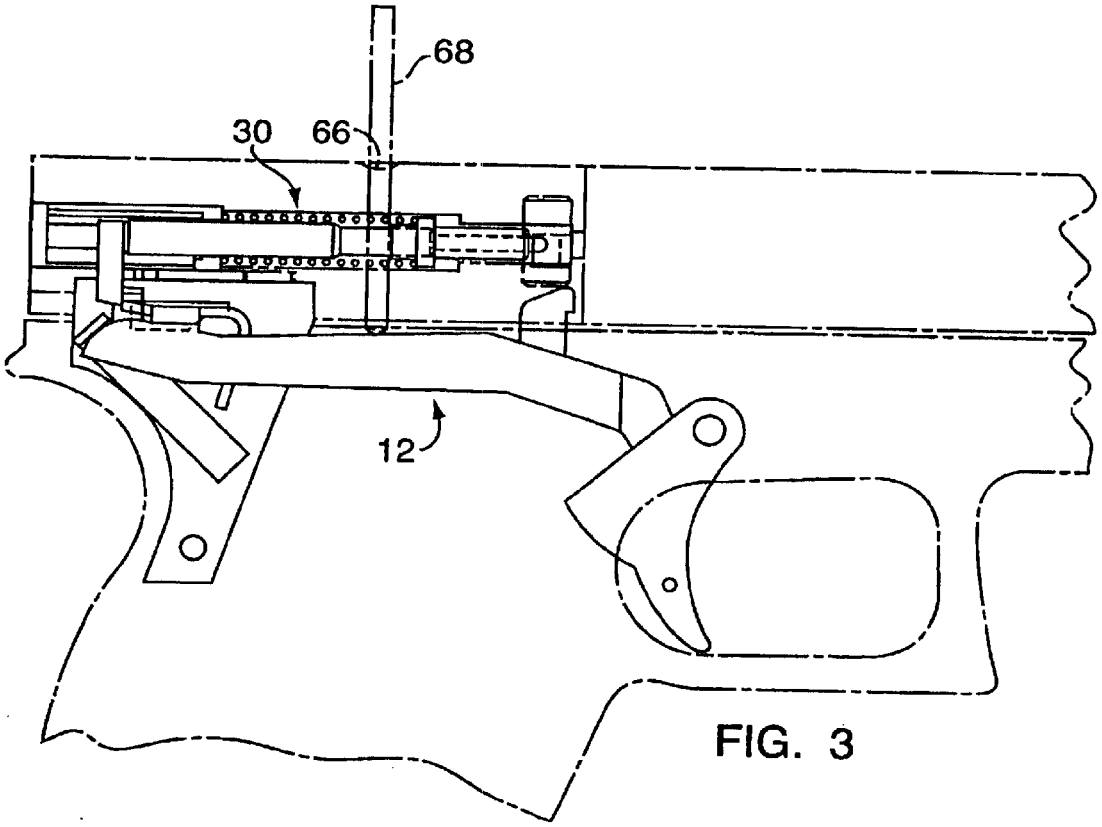
FIG. 3 is a diagrammatic partial view of a second type of pistol firing mechanism.
Figure 4:
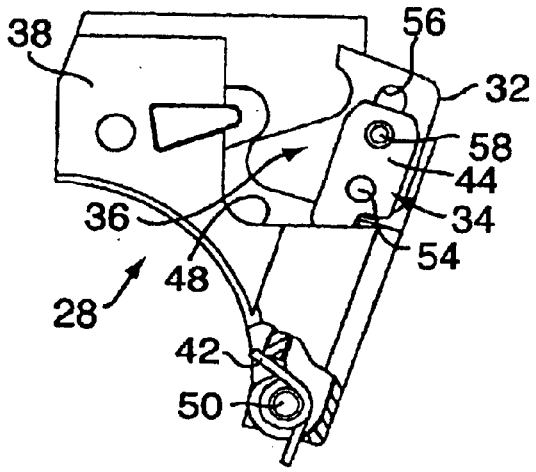
FIG. 4 is a diagrammatic face view of a sear assembly.
Figure 5:
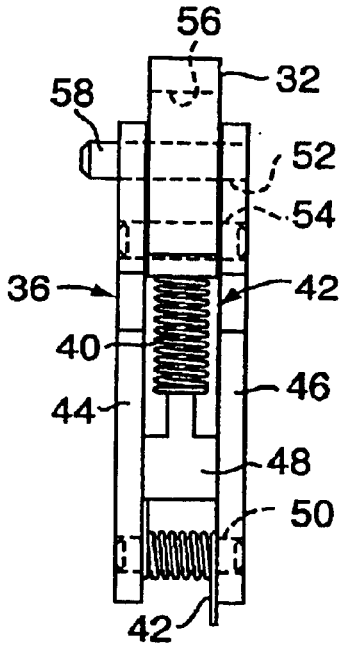
FIG. 5 is a diagrammatic side view of a sear mounted in a swing arm.

Referring to FIGS. 1, 7, and 8, the apparatus 20 for removing the slide includes an access port 66 disposed in the slide 14. The access port 66 is located at a predetermined position that is aligned with the firing mechanism 12. FIGS. 1, 3, and 7 show the access port 66 positioned in the slide 14 so as to be aligned with the firing mechanism 12 when the slide is in a chamber-closed position. In other instances, the access port 66 may be positioned in the slide 14 so as to be aligned with the firing mechanism 12 when the slide is an alternative position; e.g., a chamber-open position. A probe 68 inserted into the access port 66 can be used to manipulate the firing mechanism 12 to allow removal of the slide from the frame even when the magazine 16 is not received within the magazine well. In terms of the above-described firearm that utilizes a sear 32, the access port 66 is deposed in the slide 14 and aligned with the sear 32 when the slide 14 is in the chamber-closed position. In this position, the probe 68 can be inserted into the access port 66 and brought into contact with the sear 32. Inserting the probe 68 further into the access port 66 causes the sear 32 to depress within the sear housing 38 and out of engagement with striker firing pin mechanism 30. Once the sear and the striker firing-pin mechanism are disengaged, the slide can be drawn back along the rails and removed from the pistol frame. The apparatus 20 for removing the slide is not limited to the firing mechanism shown in FIGS. 1 and 2. In addition, in those instances where the firearm includes a magazine safety, the apparatus 20 for removing the slide may also be aligned with the magazine safety 18 so that slide 14 can be removed by disengaging the magazine safety 18 via the access port 66.

As therefore generally shown in FIGS. 1 and 7, and specifically enumerated in FIG. 8, the slide 14 includes a housing 80 that extends longitudinally and substantially parallel to a direction of movement of the slide 14. The access port 66 is therefore formed int the housing 80 so as to provide selective access to the sear assembly 28.

Although this invention has been shown and described with respect to the detailed embodiments thereof, it will be understood by those skilled in the art that various changes in form and detail thereof may be made without departing from the spirit and the scope of the invention. For example, the above Detailed Description of the Invention describes the invention in the context of a firearm having a firing mechanism that includes a sear assembly 28 and an access port 66 aligned with the sear 32. Alternatively, the access port 66 might be aligned with another element of the firing mechanism 12, or the firing mechanism 12 might utilize a mechanism other than a sear 32 to actuate the striker firing-pin 30. FIG. 3, for example, shows an alternative type of firing mechanism 12 with which the present invention can be used.

What is claimed is:

1. A semi-automatic firearm, comprising:

a magazine;

a frame with a magazine well for receiving the magazine;

a slide removably mounted on the frame, wherein the slide may be in a chamber closed position and a chamber open position;

a striker firing-pin assembly mounted within the slide;

a firing mechanism having a trigger, a trigger bar, and a sear;

a sear assembly that includes a sear housing and a sear guide, wherein said sear is slidably mounted within said sear housing and guided by said sear guide;

an access port disposed in the slide; and wherein when the slide is in said chamber closed position, said access port is aligned with the sear and said sear is accessible through said access port.

2. The firearm of claim 1, wherein said the assembly further comprises a sear spring that biases the sear substantially toward the slide.

3. The firearm of claim 1, wherein the sear assembly further comprises a pivot arm, wherein the sear is slidably attached to the pivot arm and the pivot arm is pivotally attached to the sear housing.

4. The firearm of claim 3, wherein the sear guide extends through a slot in the sear and a sear spring biases the sear into contact with the sear guide.

5. The firearm of claim 3 further comprising a magazine safety that impairs the movement of the firing mechanism so that the firing mechanism cannot be actuated.

6. The firearm of claim 5 wherein the magazine safety comprises a lever that engages a pin attached to the sear when the magazine safety is on, and thereby impairs lateral movement of the sear.

7. The firearm of claim 1, wherein inserting a probe into the access port and moving the sear with the probe permits the slide to be removed from the frame.

8. A semi-automatic firearm, comprising:

a frame;

a slide removably mounted on the frame;

a firing mechanism; and an access port disposed in the slide;

a magazine safety that impairs the movement of the firing mechanism so that the firing mechanism cannot be actuated;

wherein the magazine safety comprises a lever that engages a pin attached to the sear when the magazine safety is on, and thereby impairs lateral movement of the sear; and wherein the firing mechanism is accessible through the access port and can be manipulated to allow removal of the slide from the frame.

9. The firearm of claim 8 wherein the access port is aligned with the firing mechanism when the slide is in a chamber-closed position.

10. A semi-automatic firearm, comprising:

a frame;

a slide mounted on said frame and having a front portion adjacent a discharge end of said firearm and a rear portion oriented on an opposing, distal end of said slide, wherein said slide may be in one of a closed position and an open position;

an ejection port formed in said slide;

a rear sight oriented on said rear portion of said slide;

a firing mechanism including a sear; and an access port formed in said slide, between said ejection port and said rear sight; and wherein when said slide is in said chamber dosed position, said sear is accessible through said access port.

* * * * *

UNITED STATES PATENT AND TRADEMARK OFFICE

CERTIFICATE OF CORRECTION

PATENT NO. : 6,865,979 B1
DATED : March 15, 2005
INVENTOR(S) : Pardip K. Vaid

It is certified that error appears in the above-identified patent and that said Letters Patent is hereby corrected as shown below:

Column 4,
Line 28, after "therefore formed", please delete "int the" and insert -- in the --.

Column 6,
Line 23, after "said chamber", please delete "dosed" and insert -- closed --.

Signed and Sealed this

Twenty-fourth Day of May, 2005

JON W. DUDAS
*Director of the United States Patent and Trademark Office*